US007546932B2

(12) United States Patent
Smith et al.

(10) Patent No.: US 7,546,932 B2
(45) **Date of Patent: *Jun. 16, 2009**

(54) ERGONOMIC DISPOSABLE CUP HAVING IMPROVED STRUCTURAL INTEGRITY

(75) Inventors: Stephen Alan Smith, Naperville, IL (US); Kevin Ray Smith, Round Lake Beach, IL (US); Warren Giles Wiedmeyer, Trevor, WI (US); Kimberly Vaile Healy, Chicago, IL (US); Randy Golden, Ada, OK (US); Rudy DesChamps, Mahomet, IL (US); Irshad Khan, Round Lake Beach, IL (US); Bryce C. Rutter, St. Louis, MO (US); Brian C. Bone, St. Louis, MO (US); John H. Loudenslager, Phoenix, AZ (US); Jan Rolf Stillerman, Phoenix, AZ (US)

(73) Assignee: Solo Cup Operating Corporation, Highland Park, IL (US)

( * ) Notice: Subject to any disclaimer, the term of this patent is extended or adjusted under 35 U.S.C. 154(b) by 742 days.

This patent is subject to a terminal disclaimer.

(21) Appl. No.: 10/676,807

(22) Filed: Oct. 1, 2003

(65) Prior Publication Data

US 2005/0061821 A1 Mar. 24, 2005

(51) Int. Cl.
*B65D 1/44* (2006.01)

(52) U.S. Cl. ..... 220/675

(58) Field of Classification Search ..... None
See application file for complete search history.

(56) References Cited

U.S. PATENT DOCUMENTS

| | | | | |
|---|---|---|---|---|
| 703,125 | A | | 6/1902 | Emrich |
| 1,636,174 | A | | 7/1927 | Dolan et al. |
| 2,013,243 | A | | 9/1935 | Landon |
| 2,629,534 | A | | 2/1953 | Reynolds |
| 2,905,350 | A | | 9/1959 | Edwards |
| 3,009,603 | A | | 11/1961 | Stockdale |
| 3,085,730 | A | | 4/1963 | Fibish |
| 3,091,360 | A | | 5/1963 | Edwards |
| D196,271 | S | * | 9/1963 | Edwards ..... D9/429 |
| D197,313 | S | | 1/1964 | Wanderer |
| 3,126,139 | A | | 3/1964 | Schechter |

(Continued)

FOREIGN PATENT DOCUMENTS

| | | |
|---|---|---|
| DE | 1 175 564 | 8/1964 |

(Continued)

OTHER PUBLICATIONS

Communication from the European Patent Office transmitting an International Search Report, mailed Nov. 19, 2004, for International Application No. PCT/US2004/009357.

*Primary Examiner*—Stephen Castellano

(57) ABSTRACT

A container is disclosed, generally having an open top defined by an annular rim, a base, and a sidewall extending between the top and the base. The sidewall has two arcuately formed longitudinal recesses, an annular rib, an annular shoulder located between the longitudinal recesses and the base, and a lower portion extending between the annular shoulder and the base. The annular shoulder is characterized by two arched portions aligned with the longitudinal recesses, and the lower portion has two beveled portions aligned with the longitudinal recesses. This container is more ergonomic, and has greater sidewall strength and rigidity, than existing containers.

14 Claims, 14 Drawing Sheets

U.S. PATENT DOCUMENTS

| | | | | | |
|---|---|---|---|---|---|
| D198,139 | S | | 5/1964 | Edwards | |
| 3,131,845 | A | | 5/1964 | Sherlock et al. | |
| 3,139,213 | A | | 6/1964 | Edwards | |
| D199,336 | S | | 10/1964 | Wanderer | |
| D199,579 | S | | 11/1964 | Davis | |
| 3,223,305 | A | * | 12/1965 | Edwards | 229/400 |
| 3,288,340 | A | | 11/1966 | Shapiro et al. | |
| 3,342,370 | A | | 9/1967 | Johnson | |
| D208,872 | S | | 10/1967 | Davis | |
| D210,767 | S | | 4/1968 | Anglada | |
| D211,514 | S | | 6/1968 | Amberg | |
| 3,397,867 | A | | 8/1968 | van't Hoff | |
| D213,094 | S | | 1/1969 | Davis | |
| D213,173 | S | | 1/1969 | Lockhart et al. | |
| D213,174 | S | | 1/1969 | Davis | |
| 3,519,165 | A | * | 7/1970 | Hawley | 206/519 |
| 3,951,266 | A | | 4/1976 | Brewer | |
| 4,049,187 | A | | 9/1977 | Florian | |
| 4,052,037 | A | | 10/1977 | Mair et al. | |
| 4,061,782 | A | | 12/1977 | Baxter | |
| 4,134,492 | A | | 1/1979 | Lucas | |
| 4,245,685 | A | | 1/1981 | Nemitz et al. | |
| 4,420,081 | A | | 12/1983 | Dart | |
| D272,794 | S | | 2/1984 | Dart | |
| 4,548,348 | A | | 10/1985 | Clements | |
| D285,032 | S | | 8/1986 | Alonzo | |
| D346,308 | S | | 4/1994 | Cautereels et al. | |
| 5,415,339 | A | | 5/1995 | Howard | |
| 5,423,160 | A | | 6/1995 | Rosén | |
| D368,234 | S | | 3/1996 | Dickinson et al. | |
| D387,619 | S | | 12/1997 | Gross et al. | |
| D410,174 | S | | 5/1999 | Sheu | |
| D413,067 | S | | 8/1999 | Haley | |
| D416,757 | S | | 11/1999 | Ginuntoli | |
| D436,295 | S | | 1/2001 | Furman et al. | |
| D441,252 | S | | 5/2001 | Gitschlag | |
| 6,264,068 | B1 | | 7/2001 | Ours et al. | |
| D446,687 | S | | 8/2001 | Furman et al. | |
| D448,976 | S | | 10/2001 | McDonough et al. | |
| D461,369 | S | * | 8/2002 | Sims et al. | D7/531 |
| 6,554,154 | B1 | | 4/2003 | Chauhan et al. | |
| 6,575,320 | B2 | * | 6/2003 | Ota et al. | 215/381 |
| 2003/0157224 | A1 | | 8/2003 | Westerhof et al. | |

FOREIGN PATENT DOCUMENTS

| | | |
|---|---|---|
| DE | 1 216 139 | 5/1966 |
| DE | 44 19 161 A1 | 12/1995 |
| DE | 298 02 377 U1 | 6/1998 |
| EP | 0 371 918 | 6/1990 |
| FR | 2207836 | 6/1974 |
| GB | 395996 | 7/1933 |
| GB | 1096451 | 12/1967 |
| GB | 1 251 595 | 10/1971 |
| GB | 1 461 394 | 1/1977 |
| GB | 2 352 612 A | 7/2001 |

* cited by examiner

ERGONOMIC DISPOSABLE CUP HAVING IMPROVED STRUCTURAL INTEGRITY

TECHNICAL FIELD OF THE INVENTION

The present invention relates generally to the field of thermoformed nestable containers, specifically, the construction of a container such as a cup or cup-like article that is capable of being nested with a similar article. More specifically, the present invention, in its preferred embodiment, relates to improved grippability and structural integrity in thermoformed nestable containers.

BACKGROUND OF THE INVENTION

For several decades, there has been an increase in the use of disposable containers by consumers at the workplace, in public areas such as parks, beaches, campgrounds, and the like, as well as in the home. Generally, disposable, nestable containers made of foam materials—e.g., Styrofoam®—and insulated paper were once the only alternatives to glass or reusable plasticware containers. However, in recent years, thermoformed plastic molded containers have been a replacement to the less environmentally concerned foam articles in the industry. In particular, the use of nestable thermoformed containers has been on the rise. These thermoformed articles are also remarkably useful in containing cold fluids.

Thermoplastic materials are particularly advantageous for manufacturers as the materials do not require expensive foaming agents and need no surface lamination—each of which is a feature resulting in fewer stages of the manufacturing process. Moreover, for consumers, containers constructed from these materials are generally more durable than paper containers, are usually of a single-piece construction, and are inexpensive and recyclable.

Thermoforming begins with a thin sheet or web of material such as polyethylene, polypropylene, polyester, or polystyrene having a thickness within a range of from approximately 8 mils to 100 mils, depending on the size of the container to be manufactured. Cups and similar articles are typically made from plastic sheet having a pre-thermoforming thickness from approximately 30 to 60 mils, but the finished articles may be thinner after thermoforming. The sheet or web is heated to a temperature suitable for thermoforming—in a range from approximately 110° C. to about 200° C. for the above-mentioned materials—and is thereafter fed into a conventional forming machine in which the process proceeds under applied positive and/or negative air pressure conditions. A mold cavity is used to impart a particular formational construction into the thin-walled container as the plastic material is drawn into the mold using vacuum pressure on one side of the article and/or a positive pressure on the opposite surface of the material. The formational construction of the container may be decorative, but generally has a particular utility—e.g., texturing for grasping and formations for nestability in addition to other utilities. The processing period for a normal thermoforming operation is typically between 1 and 20 seconds.

One disadvantage to many existing cup and container designs is that the round design is not conducive to gripping, a problem encountered with all cup designs, but especially in larger-volume cups. The user must often exert more than a desirable amount of gripping pressure, in order to stabilize a cup that is too large to wrap fingers around. Additionally, cold drinks often cause condensation on the outside of a cup, creating a problem with slipping, especially with smooth plastic cups. Although this slipping is a problem itself, it can be exacerbated in a cup lacking a stable gripping surface. Annular ribs may increase the friction between the cup and the user's hand to help alleviate slipping, but do not do anything to remedy the gripping problems associated with the round design. Therefore, a need exists to provide a more ergonomic and stable gripping surface for a thermoformed plastic cup, especially a larger-volume cup, while at the same time reducing slipping caused by condensation on the outside of the cup.

Another problem with thermoformed plastic nestable containers is structural integrity. Sidewalls of thin-walled thermoformed containers often bend and deflect inward easily when grasped by a user. A deflection of this sort may constrict the volume of the container causing unpleasant fluid overflows. Additionally, deflection of the sidewall can make the container more difficult to grip, as well as potentially leading to cracking. One solution to the identified problem is to provide thicker material constructions, but this increases production costs. Additionally, thicker constructions tend to increase the stack height among nested containers. These respective phenomena limit the number of containers that may be nested in a confined area and can prevent the nested containers from being easily separated. Another, more effective means known and used in the art is creating annular ribs and/or shoulders in the sidewall, which can add significant rigidity to the surrounding areas of the sidewall. Creating rigidity-enhancing features in the sidewall avoids the problems associated with using a thicker sidewall. However, the strength enhancement that may be achieved by using ribs and shoulders is limited, especially in the middle regions of the sidewall, where gripping normally occurs. Therefore, a need exists to further increase the strength of the sidewall of a thermoformed container, while avoiding the use of thicker material.

The present invention solves these two problems primarily by creating arcuately formed longitudinal recesses in the sidewall. These recesses both provide an ergonomic and effective gripping surface and increase structural integrity. However, the recesses can create problems with proper nesting of the containers, which tend to telescope because of their lack of complete rotational symmetry. Thus, a need further exists for a means to ensure proper nesting of containers having recesses in their sidewalls.

Additionally, containers having recesses in their sidewalls may rub together during manufacturing. Cups are often stacked inside each other while being transported along a line by machinery during certain manufacturing processes. The cups may rotate during this movement, causing them to rub against the cups stacked above and below them. This rubbing can create wear on the cup, scratching the surface. While not all manufacturing processes present this problem, it can be a source of concern when manufacturing containers having recesses in their sidewalls. Thus, a need exists to solve the problem of rubbing caused by movement and rotation of the cups during manufacturing.

The present invention provides an economical solution to the recognized problems. The present invention is intended to provide a suitable formational construction for thin-walled thermoformed containers.

SUMMARY OF THE INVENTION

A thermoformed container having improved structural integrity in the sidewall is disclosed, the container generally including an open top defined by an annular rim, a base, and a sidewall extending between the top and the base. The sidewall has several features increasing structural integrity, as well as facilitating gripping and nesting. These features include two arcuately formed longitudinal recesses, an annular shoulder located between the recesses and the base, and a lower portion extending between the annular shoulder and the base. Generally, the recesses terminate at the annular shoulder. The annular shoulder is characterized by two arched portions aligned with the recesses, and the lower portion is characterized by two beveled portions aligned with the recesses. The sidewall may also have at least one annular rib, characterized by two curved portions substantially aligned with the recesses.

According to a first aspect of the invention, the sidewall has a measurably improved strength to weight ratio over a substantially similar sidewall having no recesses. According to another aspect of the invention, the annular shoulder contains a means for stabilizing the container when held by a user. According to a further aspect of the invention, the container includes a means for ensuring proper nesting of the container upon another identical container. One such means for ensuring proper nesting is the use of raised ledges on the inner surface of the sidewall, which sit within the arched portions on the outer surface of the sidewall as the containers are stacked together.

Alternate embodiments are disclosed and claimed, in addition to the preferred embodiment. In one alternate embodiment, the annular shoulder has no arched portions, and the base, the lower portion, and the annular shoulder are substantially elliptically shaped. In another alternate embodiment, the sidewall has a greater number of recesses, generally in the range of from 1 to 20 recesses, and preferably in the range of from 2 to 12. The number of arched portions in the annular shoulder, curved portions of the annular rib(s), or beveled portions of the lower portion is generally equal to the number of recesses in the sidewall.

BRIEF DESCRIPTION OF THE DRAWINGS

In the accompanying drawings forming part of the specification, and in which like numerals are employed to designate like parts throughout the same.

DETAILED DESCRIPTION OF PREFERRED EMBODIMENT

Figure 1:
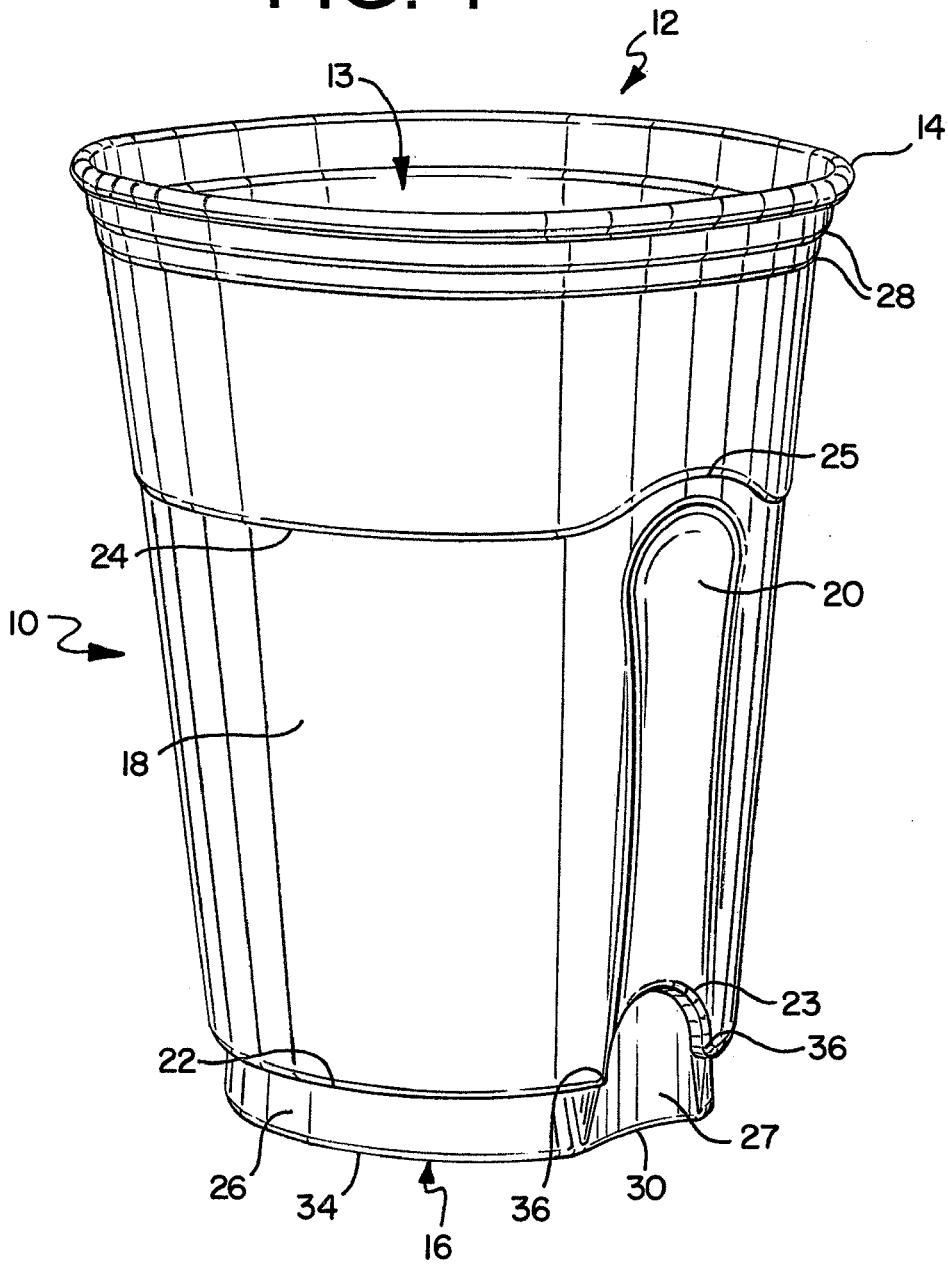
FIG. 1 is a perspective view of a cup representing the preferred embodiment of the present invention.

While the invention is susceptible of embodiment in many different forms, this disclosure describes, in detail, preferred embodiments of the invention with the understanding that the present disclosure is to be considered as an exemplification of the principles of the invention and is not intended to limit the broad aspects of the invention to the embodiments illustrated.

Referring generally to the appended FIGS. 1-27, the present invention can be more readily understood. The disclosed preferred container is generally referenced by the number "10" in the following disclosure and drawings. Other components are similarly and consistently numbered throughout the specification and drawings. While the present invention is particularly designed for use in thermoformed cups, cups made from other manufacturing processes and other types of containers may also be capable of utilizing and benefitting from the disclosed invention.

As illustrated in FIGS. 1-9, the container is generally a thermoformed cup 10 including an open top 12 defined by an annular rim 14, a base 16, and a sidewall 18 extending between the top 12 and the base 16. The sidewall 18 has at least one recess 20 and an annular shoulder 22 located between the recess 20 and the base 16, and the annular shoulder 22 has at least one arched portion 23. Preferably, the cup 10 also includes at least one annular rib 24 and a lower portion 26 extending between the annular shoulder 22 and the base 16, having at least one beveled portion 27 aligned with the recess 20.

Figure 4:
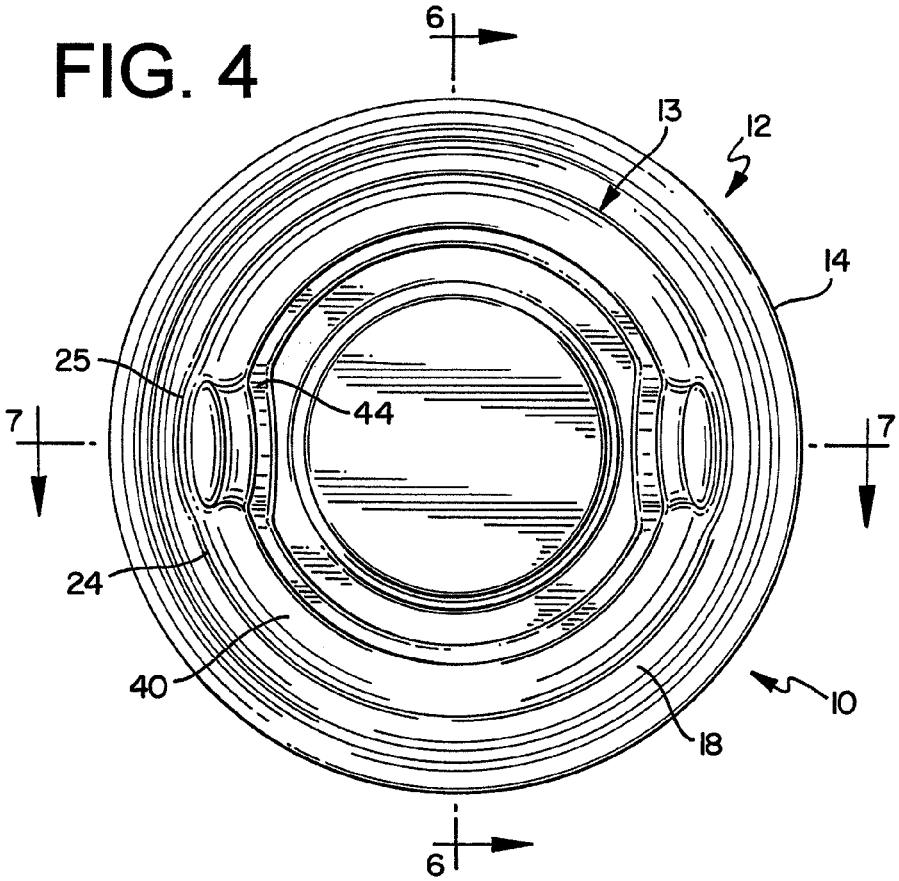
FIG. 4 is a top plan view of the cup shown in FIG. 1.

The top 12 of the cup 10 is a generally circular opening 13 defined by an annular rim 14, as shown in FIGS. 1 and 4. The rim 14 is preferably thicker and rolled toward the outside of the cup 10, which is a common characteristic of thermoformed drinking cups. The rolled rim 14 forms a smooth surface for contact with the mouth of a user, as well as providing increased strength and rigidity to the top 12 of the cup 10. Although a rolled rim 14 is preferred, other known rim 14 configurations may be used in accordance with the present invention.

Figure 5:
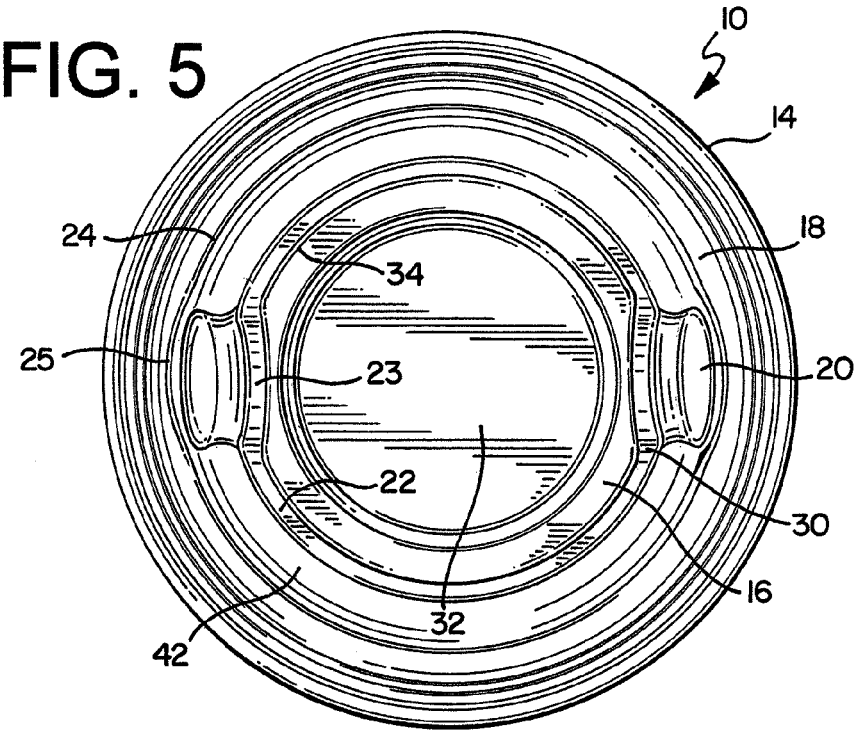
FIG. 5 is a bottom plan view of the cup shown in FIG. 1.
Figure 8:
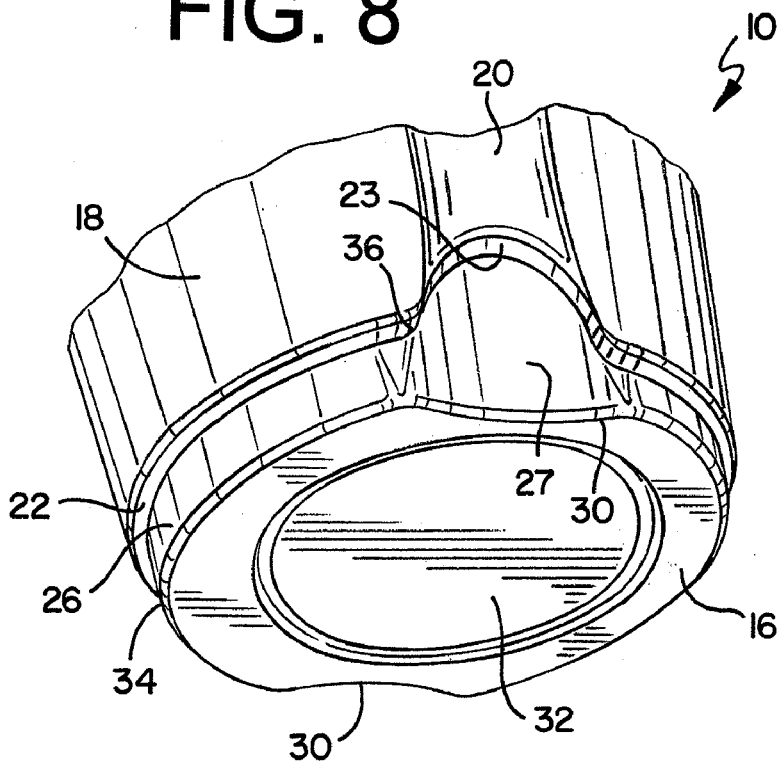
FIG. 8 is a focused perspective view of the bottom of the cup shown in FIG. 1, magnified to show detail in the annular shoulder and the arched portions.
Figure 9:
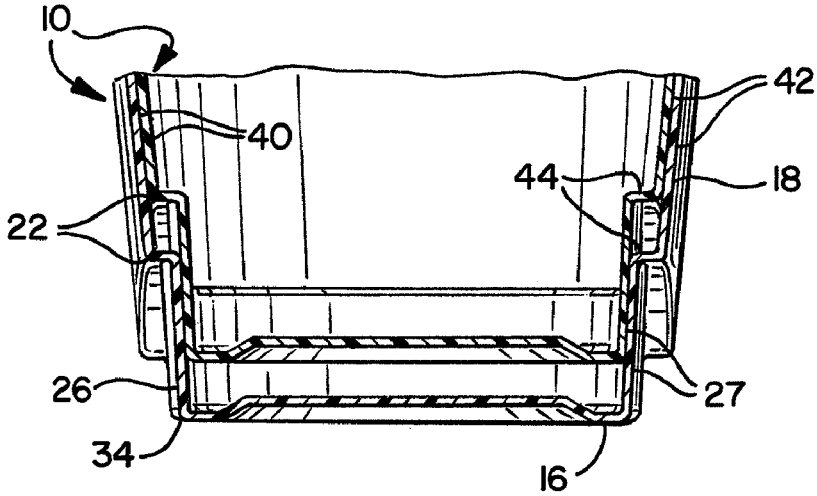
FIG. 9 is a partial cross-section view of the cup shown in FIG. 1 nested upon an identical cup, taken along line 2-2 in FIG. 4.
Figure 11:
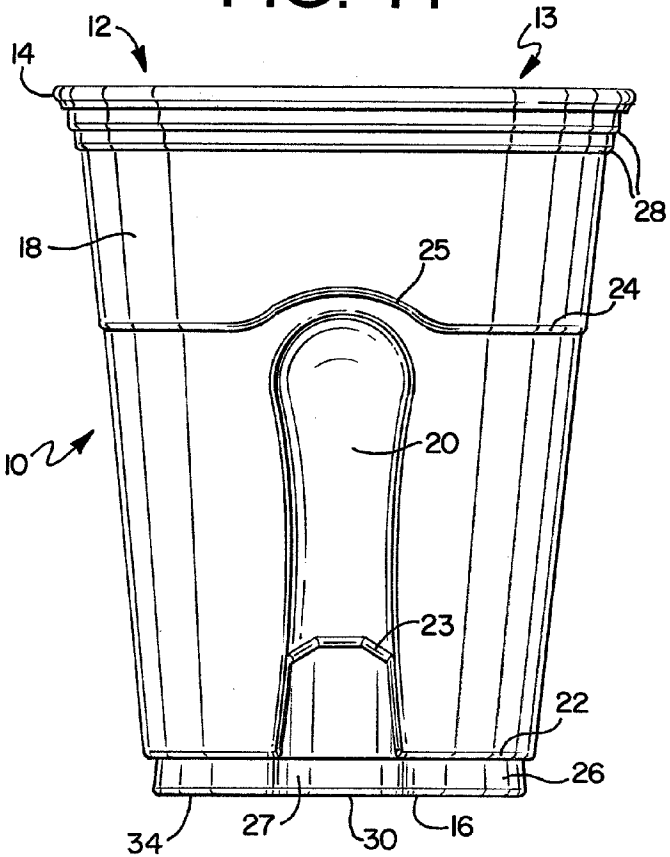
FIG. 11 is a side elevation view of the cup shown in FIG. 10.
Figure 10:
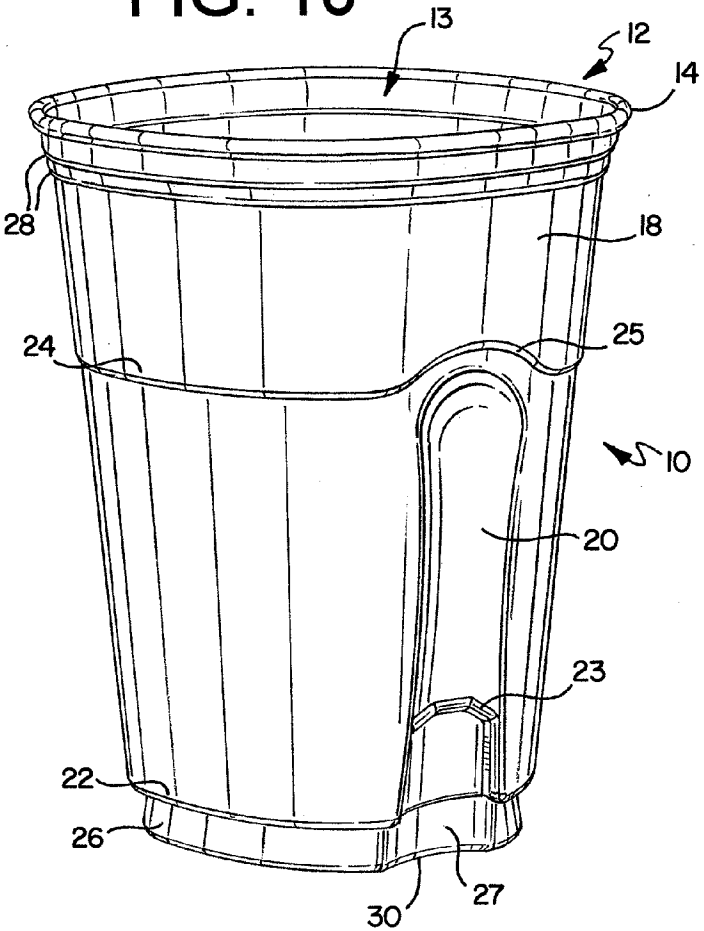
FIG. 10 is a perspective view of a cup representing an alternate embodiment of the present invention, having sharply angled arched portions and concavely curved beveled portions.
Figure 13:
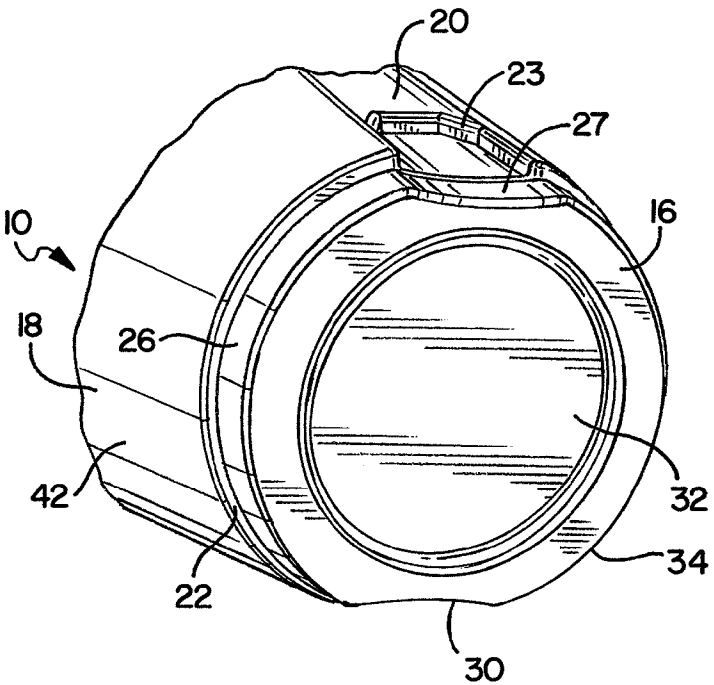
FIG. 13 is a focused perspective view of the bottom of the cup shown in FIG. 10, magnified to show detail in the annular shoulder and the arched portions.
Figure 12:
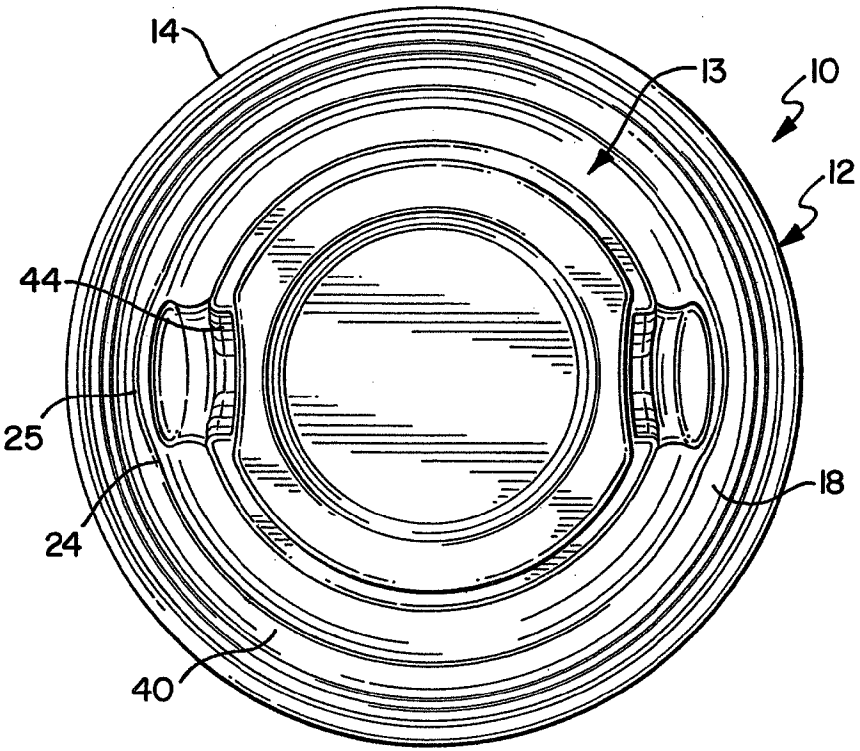
FIG. 12 is a top plan view of the cup shown in FIG. 10.
Figure 27:
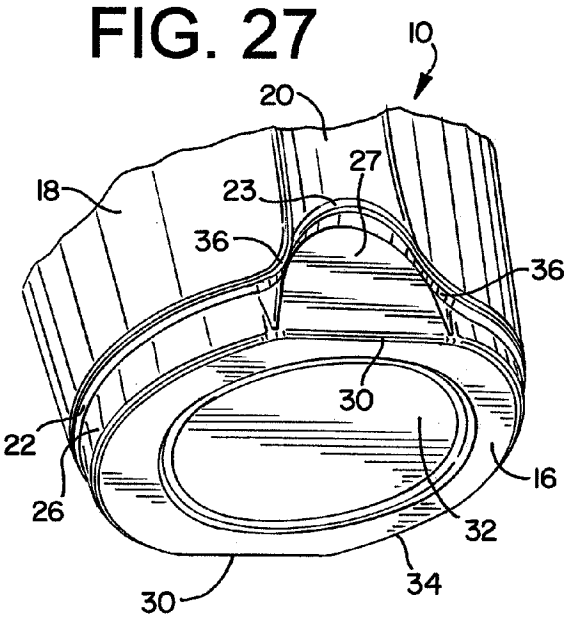
FIG. 27 is a focused perspective view of the bottom of the cup shown in FIG. 26, magnified to show detail in the annular shoulder and the arched portions.
Figure 26:
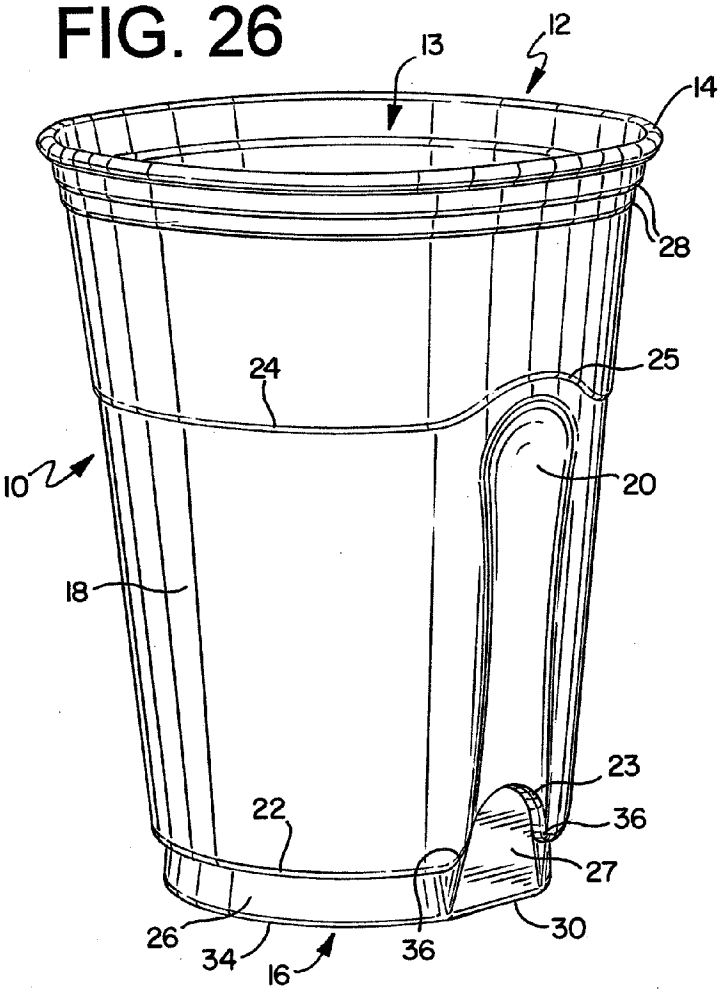
FIG. 26 is a perspective view of a cup representing an alternate embodiment of the present invention, wherein the beveled portions are flat and the and the transition between the shoulder and the arched portion is smooth.

As illustrated in FIGS. 5 and 8, the base 16 is connected to the lower portion 26 of the sidewall 18, and is generally a circular disk having beveled edges 30 and a circular recess 32 in the center. The shape of the base 16 need not be circular, as a multitude of other shapes will function effectively. Additionally, the recess 32 may not be circular, or alternatively, may not be present at all. Notably, the shape of the top 12 need not be the same as the base 16. In one embodiment of the cup 110, the base 116 is elliptical and the top 112 is circular. In the preferred embodiment, the base 16 has beveled edges 30 corresponding to the beveled portions 27 of the lower portion 26 of the sidewall 18 (discussed below). Preferably, the beveled edges 30 are concavely curved, as shown in FIGS. 1 and 8. Alternatively, the beveled edges 30 may be straight, as shown in FIGS. 26 and 27, or may take another shape, but their shape is generally dependent on the shape of the beveled portions 27 of the lower portion 26. The recess 32 in the center of the base 16 both improves the rigidity of the base 16 and provides a more stable and balanced surface for resting upon another surface. The base 16 is connected to the sidewall 18 around its entire perimeter, forming a base shoulder 34.

The sidewall 18 connects the top 12 with the base 16, extending between the top 12 and the base 16 and making up the bulk of the container. The sidewall 18 is generally cylindrical, as shown in FIGS. 1-7, and, because the opening 13 is generally larger than the base 16, the sidewall 18 tapers from top 12 to the base 16. In other words, the diameter of the cylinder formed by the sidewall 18 is larger near the top 12 and decreases as the base 16 is approached, creating a frustoconical shape. However, as discussed below, the lower portion 26 of the sidewall 18 preferably has an opposite taper relative to the rest of the sidewall 18. The shape of the sidewall 18 is largely dictated by the shapes and sizes of the top 12 and the base 16, and thus, the sidewall 18 may have one of a variety of other shapes. The sidewall 18 has several characteristic features, including one or more recesses 20, an annular shoulder 22, a lower portion 26 connecting the annular shoulder 22 to the base 16, and one or more annular ribs 24,28.

Figure 24:
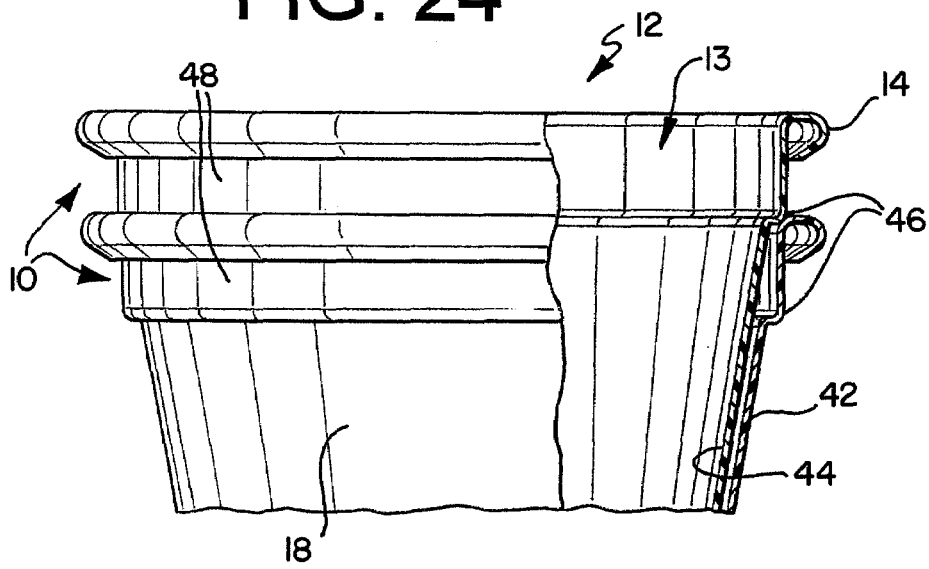
FIG. 24 is a broken cross-section view of the top of a cup having an upper shoulder and a reverse-tapered upper portion nested upon an identical cup.

Alternatively, the sidewall 18 may contain an upper shoulder 46, creating an upper portion 48 extending between the upper shoulder 46 and the container top 12. The upper portion 48 is preferably tapered oppositely to the rest of the sidewall 18, as illustrated in FIG. 24. In other words, the diameter of the upper portion 46 is greater at the upper shoulder 46 than at the top 12 of the cup 10. The reverse taper of the upper portion 48 provides a means for stacking a plurality of cups 10, as shown in FIG. 24. In this embodiment, the lower portion 26 need not be reverse-tapered, and can be either completely absent or present only under the arched portions 23.

Figure 7:
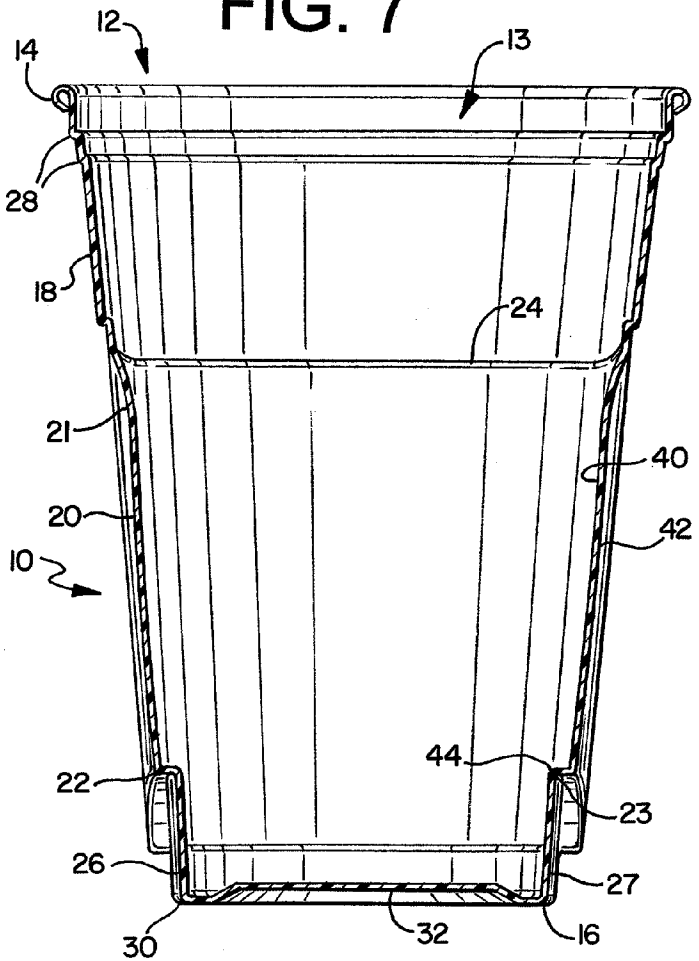
FIG. 7 is a cross-section view of the cup shown in FIG. 1, taken along line 2-2 in FIG. 4.

In the preferred embodiment, shown in FIGS. 1-9, the sidewall 18 has two recesses 20. These recesses 20 are longitudinal, i.e. having a much larger vertical dimension (perpendicular to the base 16) than a circumferential dimension. The recesses 20 are preferably arcuately formed, being circumferentially wider towards the top 12 and bottom and narrower in the middle. Further, the preferred recesses 20 are smooth and concave, curving inward toward the center of the cup 10. Preferably, the concavity of the recesses 20 is deeper relative to the rest of the sidewall 18 near the top of the recesses 20, forming a swale 21 in each recess, as illustrated in FIG. 7. The recesses 20 begin nearer to the top 12 of the cup 10 and preferably terminate at the annular shoulder 22.

Although the above characteristics are preferable, the recesses 20 can take any of a variety of different forms. For example, while the recesses 20 are preferably longitudinal and arcuately formed, these characteristics are not necessary. Also, the degree or smoothness of the concavity of the recesses 20 may vary, and the swales 21 need not be present. Alternately, the recesses 20 may not be concave, being deeply recessed near the edges of the recesses 20 and having a slight convex curvature. The surface of the recesses 20 may have ridges or projections (such as a logo) to enhance gripping, rather than being smooth. In addition, the recesses 20 may be located anywhere on the sidewall 18 and need not terminate at the annular shoulder 22. The recesses 20 may exist completely above the annular shoulder 22, or may pass through the annular shoulder 22 and extend to the base 16. Finally, the cup 10 may have any number of recesses 20. In one embodiment discussed below, the cup 10 has as many as twenty or more recesses 20. These recesses 20 serve the dual purpose of providing an ergonomic gripping surface for the user and, as discussed below, significantly increasing the strength and rigidity of the sidewall 18.

Figure 2:
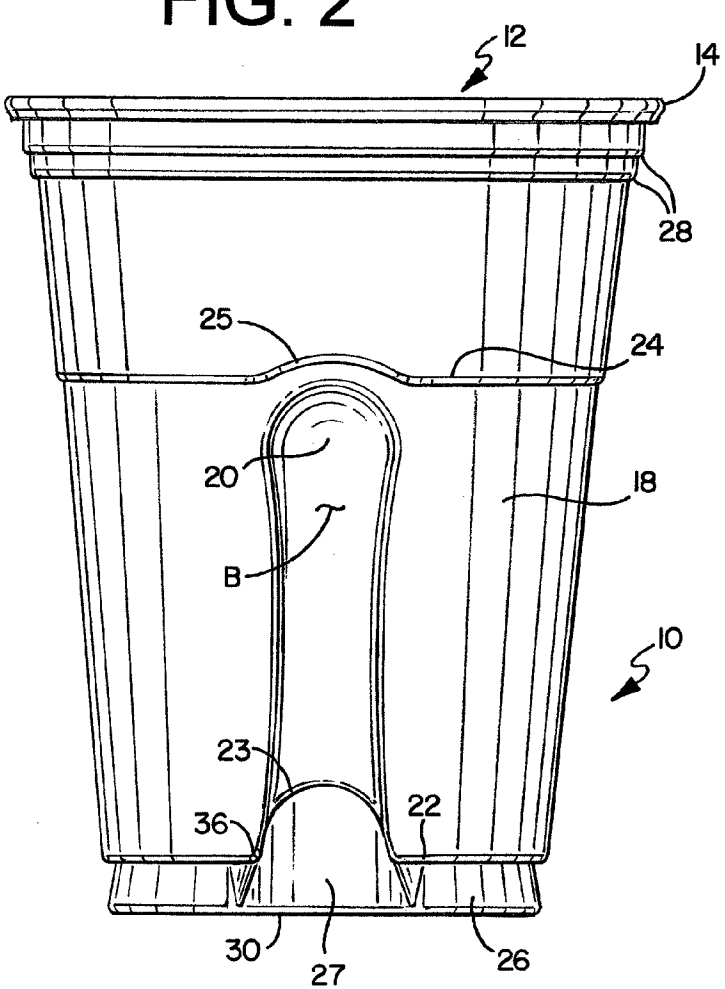
FIG. 2 is a side elevation view of the cup shown in FIG. 1.

The annular shoulder 22 exists between the recesses 20 and the base 16, as shown in FIGS. 2, 5, and 8. The annular shoulder 22 is generally circular, except for the arched portions 23 adjacent to the recesses 20. Alternately, the annular shoulder 22 may take another shape, such as an elliptical shape in one embodiment. Preferably, the entire recess 20 is located on the opposite side of the annular shoulder 22 as the base 16, and the recess 20 terminates at the annular shoulder 22. In other words, the recess 20 exists only on one side of the annular shoulder 22 and the recess 20 ends at the point of contact between the recess 20 and the annular shoulder 22. However, as noted above, the recesses 20 may pass through the annular shoulder 22, so the shoulder 22 is still considered to exist between the recess 20 and the base 16 as long as a portion of the recess 20 is located on the side of the shoulder 22 opposite the base 16.

Figure 25:
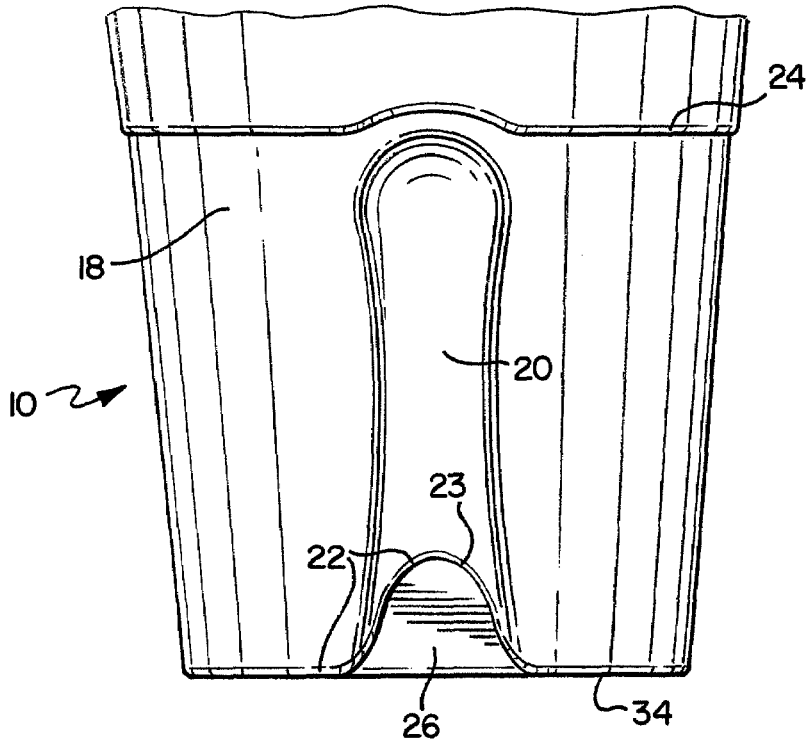
FIG. 25 is a broken side elevation view of the bottom of a cup having a recess and an arched portion, wherein the annular shoulder is partly contiguous with the base shoulder.

In the cup 10 illustrated in FIGS. 1-9, the shoulder 22 includes two arched portions 23 aligned with the two recesses 20. The shoulder 22 may contain any number of arched portions 23, and preferably, the shoulder 22 has an arched portion 23 to correspond with every recess 20. In an alternate embodiment, discussed below, the shoulder 22 contains no arched portions 23. The arched portions 23 are preferably smoothly curved with a sharp transition 36 between each arched portion 23 and the rest of the annular shoulder 22, as shown in FIGS. 1, 2, and 8. However, this is not an essential characteristic. For example, the arched portions 23 shown in FIGS. 11 and 13 have a sharp transition 36 and are polygonal in shape, while the arched portions 23 shown in FIGS. 26 and 27 have a smooth transition 36 and a smoothly curved shape. The arched portions 23 may also be square, triangular, or any other shape that accomplishes the functions articulated herein. Further, the arched portions 23 need not be aligned with the recesses, and could be located elsewhere on the annular shoulder 22, for example at a position 90 degrees around the perimeter of the sidewall 18 from the recesses 20. Finally, the annular shoulder 22 is preferably separated completely from the base 16 by the lower portion 26 of the sidewall 18. However, the annular shoulder 22 may be at the bottom of the sidewall 18, directly connecting the sidewall 18 to the base 16, with the lower portion 26 either entirely absent or only intermittently present where the annular shoulder 22 rises to form the arched portions 23, as illustrated in FIG. 25. In other words, the annular shoulder 22 may be contiguous, either entirely or in part, with the base shoulder 34 connecting the sidewall 18 to the base 16.

The sidewall 18 of the cup 10 illustrated in FIGS. 1-9 has a lower portion 26 separating the annular shoulder 22 from the base 16, the lower portion 26 including two beveled portions 27 aligned with the recesses 20. The lower portion 26 is generally annular or cylindrical, and is preferably tapered or flared oppositely to the rest of the sidewall 18, generally to provide a stacking means to a plurality of nested cups 10. In other words, the diameter of the lower portion 26 near the annular shoulder 22 is slightly smaller than the diameter at the base 16. The lower portion 26 illustrated in FIGS. 5 and 8 is generally circular, but the lower portion 26 may take different shape. In one embodiment, the lower portion 126 is elliptical. The lower portion 26 is typically more rigid than the remainder of the sidewall 18 because the annular shoulder 22 and the base shoulder 34 add strength to the lower portion 26. Finally, as described above and shown in FIG. 25, the lower portion 26 may be completely absent or only intermittently present beneath the arched portions 23 of the annular shoulder 22, if the annular shoulder 22 is wholly or partially contiguous with the base shoulder 34.

The lower portion 26 preferably has two beveled portions 27 adjacent to, and aligned with, the arched portions 23 of the annular shoulder 22 and the recesses 20. Any number of beveled portions 27 may be present, or the beveled portions 27 may be entirely absent, but preferably, the lower portion 26 has a beveled portion 27 corresponding to each recess 20. Preferably, the beveled portions 27 extend from the base to the annular shoulder 22, but the beveled portions 27 may alternately only extend a portion of the distance between the base 16 and the annular shoulder 22. In the preferred container, the beveled portions 27 are concavely curved, as shown in FIGS. 1 and 8, but this characteristic is not essential. For example, the beveled portions 27 may be flat, as shown in FIGS. 26 and 27, or convexly curved, or could take another form, such as a polygonal shape. Alternately, the base and lower portion could be elliptically shaped to effectively create beveled portions, without any blunt angles. Finally, if the arched portions 23 are not aligned with the recesses 20, the beveled portions 27 may be aligned with either the arched portions 23 or the recesses 20, or aligned with both.

The cup 10 preferably has a stacking shoulder, generally to provide a stacking means to a plurality of nested cups 10. The use of a variety of different types of stacking shoulders is well known in the art of thermoformed cup manufacturing. A stacking shoulder can provide a stacking means to a plurality of nested cups 10 in a variety of manners, by providing a point of contact at which a lower cup 10 exerts force to support an upper cup 10 nesting inside the lower cup 10. This is generally accomplished because the rapid change in diameter of the cup created by the stacking shoulder causes a point of contact between the outer surface 42 of the upper cup 10 and the inner surface 40 of the lower cup 10. The point of contact can be created, for example, between the stacking shoulder of one cup the top 12, base 16, or stacking shoulder of another cup, providing direct vertical support. Alternately, the point of contact may provide support by frictional force between the sidewalls 18 of two cups 10, rather than direct support.

In the preferred embodiment, the annular shoulder 22 functions as a stacking shoulder. This feature is illustrated, for example, in FIG. 23, where a portion of the base 216 sits upon the inner surface 240 of the annular shoulder 222 when one cup 210 is nested upon a second identical cup 210. As shown, the reverse taper of the lower portion 226 aids in providing a more effective stacking means, by allowing the base 216 to be wider in diameter than the annular shoulder 222. Alternately, the cup 10 may have a stacking shoulder located elsewhere, as is known in the art. The stacking shoulder may be located near the top 12 of the cup 10, as illustrated in FIG. 24, where the upper shoulder 46 functions as a stacking shoulder. Although the cup 10 shown in FIG. 24 contains a reverse-tapered upper portion 48, aiding in providing a stacking means, the upper portion 48 need not be reverse-tapered to function effectively. Other methods of using a stacking shoulder to provide a stacking means to a plurality of nested cups 10 are known in the art.

Figure 3:
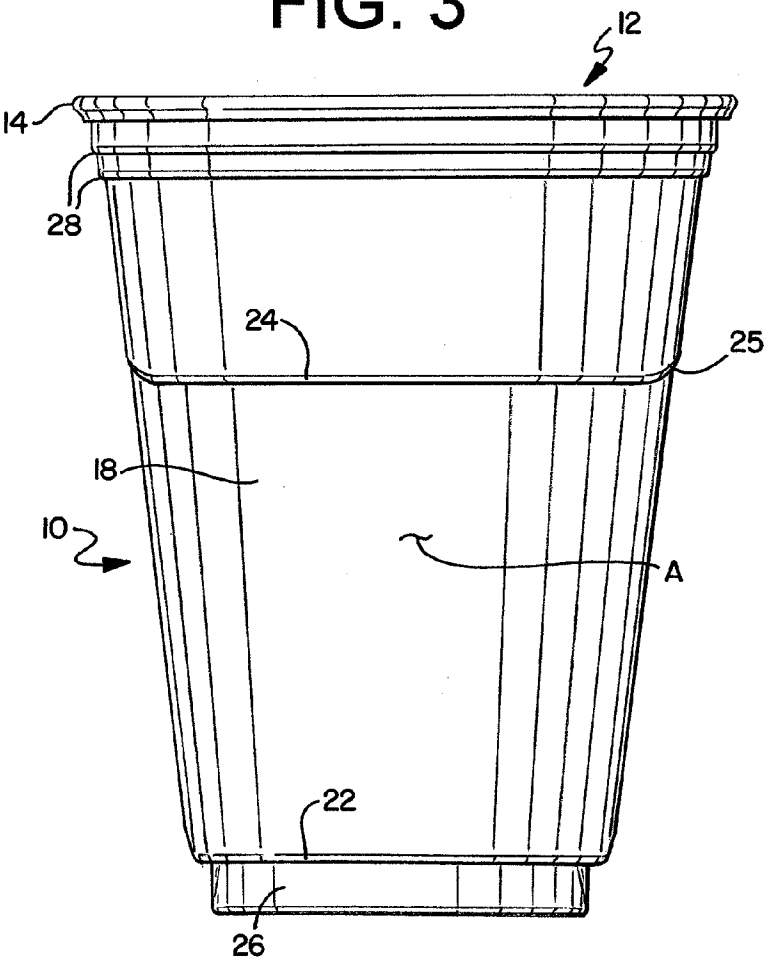
FIG. 3 is a side elevation view of the cup shown in FIG. 1, rotated 90 degrees from FIG. 2.

Multiple annular ribs 24,28 are included in the sidewall 18 to add strength, as illustrated in FIGS. 1-3. In the preferred embodiment, the sidewall 18 has three annular ribs 24,28: two closely spaced ribs 28 near the top 12 and a single central rib 24 approximately at the top of the recess 20. The central rib 24 preferably contains two curved portions 25 aligned with the recesses 20. If a different number of recesses 20 are present, the rib 24 preferably contains a curved portion 25 corresponding to each recess 20. Alternately, the curved portions 25 may not be present, especially if the rib 24 is located closer to the top 12 of the cup 10, and does not have to curve around the top of the recess 20. In other embodiments, a greater or fewer number of ribs 24,28 may be present.

Figure 6:
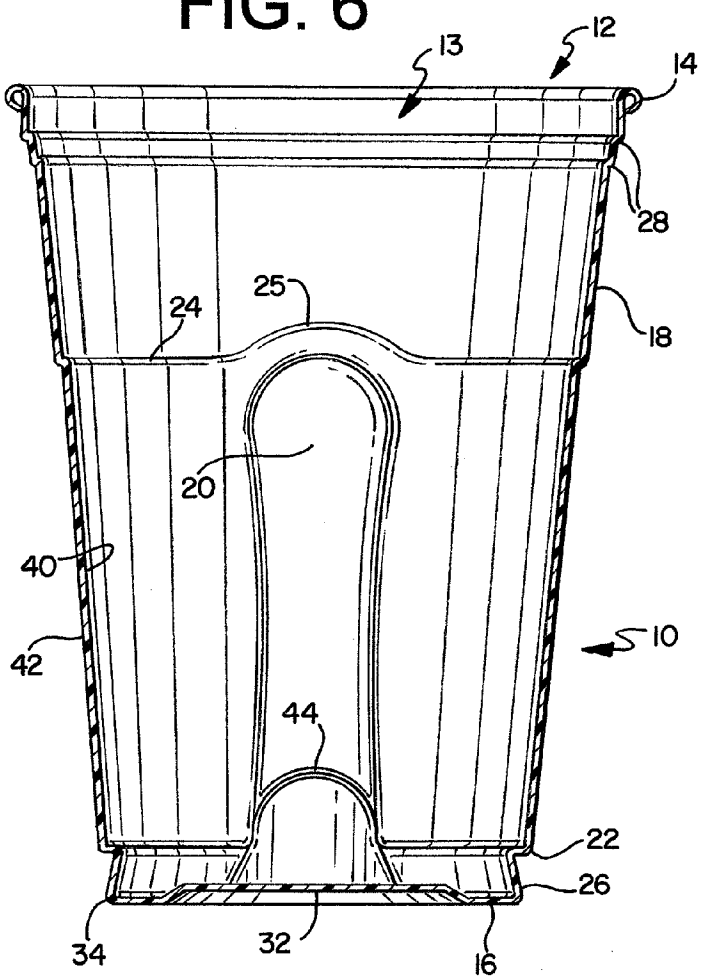
FIG. 6 is a cross-section view of the cup shown in FIG. 1, taken along line 1-1 in FIG. 4.

As illustrated in FIGS. 6 and 7, the sidewall 18 has an inner surface 40 and an outer surface 42. Most of the above-mentioned components of the cup 10 are located on the outer surface 42. The inner surface 40 includes a raised ledge 44 that is cooperatively dimensioned with the arched portion 23 so that the raised ledge 44 fits within the arched portion 23 of a second identical container when the second container is placed inside the first container. In a thin-walled thermoformed cup 10, such as the preferred embodiment, the raised ledge 44 is the inverse projection created on the inner surface 40 of the sidewall 18 as the sidewall 18 bends to form the arched portion 23. Thus, in the preferred embodiment, the arched portion 23 and the raised ledge 44 are easily formed with nearly identical dimensions. In a thicker-walled container, the raised ledge 44 may be a structure separate from the arched portion 23.

Cooperatively dimensioning the raised ledge 44 and the arched portion 23 is a means of ensuring that two cups 10 nest properly together. Such a means of ensuring proper nesting is of key importance in the thermoformed cup industry. Standard cylindrical thermoformed cups nest together easily because they are all rotationally symmetrical with each other, i.e. no matter how the cup is rotated about a central longitudinal axis, it will appear identically. Additionally, cups having nonsymmetrical sidewall features, such as vertical ribs, recesses, or embossments, will nest together easily, provided that the depth of the nonsymmetrical features is smaller than the width of the air gap that exists between two nested cups. However, adding deeper recesses 20 destroys this rotational symmetry, and the recesses 20 will not naturally align with each other as the cups 10 are randomly stacked, creating difficulty with nesting. Therefore, a means of ensuring proper nesting is necessary so that all the cups 10 in a given stack nest tightly and symmetrically together. Cooperatively dimensioning the raised ledge 44 and the arched portion 23 accomplishes this by "locking" the top cup 10 in place when it is stacked on a lower cup 10, preventing the top cup 10 from rotating and becoming misaligned. To accomplish this function, only one raised ledge 44 and one arched portion 23 are necessary. Increasing the number of raised ledges 44 and arched portions 23 may create a greater number of nesting positions, provided they are equidistantly spaced around the circumference of the sidewall 18, further improving nesting between the cups 10.

Figure 15:
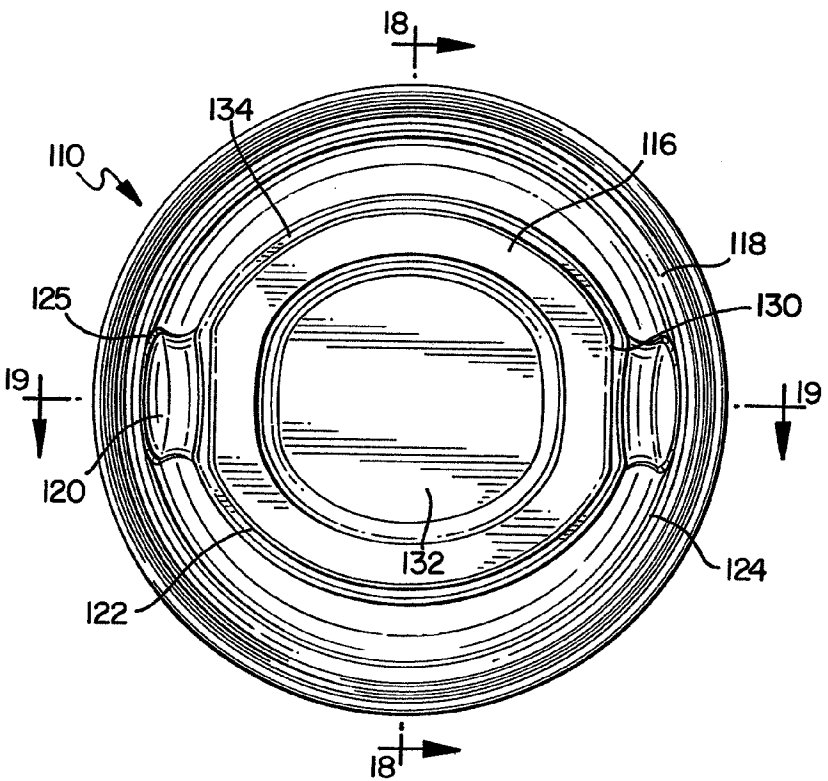
FIG. 15 is a bottom plan view of the cup shown in FIG. 14.

Another means for ensuring proper nesting is forming the base 116, the lower portion 126, and the annular shoulder 22 elliptically, rather than circularly, as shown in FIG. 15. Unlike a circle, which is perfectly rotationally symmetrical, an ellipse will not sit symmetrically upon an identical, rotated ellipse. Therefore, as cups 110 with elliptical bottoms are stacked, the elliptical shapes encourage symmetrical alignment of each cup 110 upon the next, as the cups 110 will not fit together properly unless they are substantially aligned with each other. Using an elliptical base 116 may be less effective than the arched portions 23 and raised ledges 44 in ensuring proper nesting, however, other factors may favor the use of an elliptical base 116.

A third means for ensuring proper nesting is the use of a greater number of recesses 220, consistently spaced on the outer surface 242 of the sidewall 218, projecting deeper into the cup 210 than the recesses 220 of the preferred embodiment, as shown in FIGS. 20-23. The projections of the recesses 220 on the inner surface 240 of the sidewall 218 form ridges 243 that will sit inside the recesses 220 as the cups 210 are stacked together, shown in FIG. 23. Equidistantly spacing a number of recesses 220 about the circumference of the sidewall 218 creates a number of different positions which effect proper nesting. Consequently, little manipulation may be required for the cup 210 to nest properly. Unlike the first two means for ensuring proper nesting, which "urge" the cup into one of a small number of proper nesting positions, the third means "allows" the cup 210 to nest properly by providing a number of different positions in which the cup 210 will nest properly. Still other means of ensuring proper nesting exist.

The present invention has the additional benefit of limiting movement and wear on the cups 10 during manufacturing. As stated above, movement and rotation of the cups 10 during manufacturing may cause the cups 10 to rub together. The means for ensuring proper nesting also limits the rotation of the cups 10 within each other during manufacturing, just as they do when the cups 10 are stacked together in commercial or private use. Once the cups 10 are "locked" into a proper nesting position, they do not rotate within each other or rub together. Thus, the means for ensuring proper nesting provides an additional benefit in the manufacturing of thermoformed cups 10 having longitudinal recesses 20.

Many features of the sidewall 18 increase the strength and rigidity of the sidewall 18, allowing the sidewall 18 to be made thinner, thereby potentially reducing weight and cost. Using a thickened, rolled rim 14, annular ribs 24,28, and annular shoulders 22 to increase strength and rigidity is known in the art. The present invention achieves greater strength and rigidity through the use of recesses 20 in the sidewall 18, as well as these known means. Longitudinal recesses 20 help to increase rigidity by disrupting the energy transferred to the sidewall 18 by the outside force, in this case, the user's hand. By disrupting the transferred energy and preventing it from flowing through the sidewall 18, the recesses 20 limit the area of the sidewall 18 that "gives" in response to the force, thereby increasing strength and rigidity. It was discovered that longitudinal recesses 20, such as those used in the present invention, provide more strength enhancement if they are concave and arcuately formed. Thus, the longitudinal recesses 20 of the preferred cup 10 are concave and arcuately formed.

Improved strength and structural integrity resists deflection of a container inward, which may constrict the volume of the container causing unpleasant fluid overflows. In demonstrating the improved strength and structural integrity of the present invention and its embodiments, a sidewall 18 deflection analysis was performed and compared to that of a standard round thermoformed cup. These containers differ negligibly in thermoplastic thickness and are generally evaluated to be from 10 mils to 40 mils. The results from this analysis were obtained via a standardized procedure in the field of thermoformed containers. This procedure is described below with its corresponding results illustrated in Tables I and II.

The materials preferred for this standardized procedure include (1) several standard round thermoformed cups, (2) several cups identified herein as the preferred embodiment of the present invention, having longitudinal recesses 20, (3) a Chatillon® DFGS digital force gauge, (4) a Chatillon® TCD-200 tension and compression tester, (5) a container rigidity fixture and (6) Chatillon® AutoTest™ software.

This standardized procedure involves apparatus set-up and analysis. Specifically, (1) attaching the container rigidity fixture to the compression tester in a level manner, (2) aligning the container mounting fixture to permit test deflection at two-thirds the height of a container, which is the most commonly grasped area during use, (3) zeroing the appropriate gauges, (4) setting the deflection limit at one quarter inch, and (5) setting the travel speeds of the deflection apparatus. Moreover, analyzing sidewall 18 deflection includes (1) placing a first sample into the container mounting fixture, (2) slowly lowering the probe of the force gauge onto the samples, and (3) reading and recording the maximum force value on the gauge as the sidewall 18 of the sample deflects one quarter inch, the limit for deflection. This procedure is duplicated as necessary for analysis and study. It should be noted that the testing illustrated herein was performed on a thermoformed cup having a nominal capacity of 18 oz. While containers of different sizes might test differently, similar results are expected for containers of other common sizes.

Table I includes the data obtained by testing the deflection at Point A, shown in FIG. 3. Point A is located on the bare portion of the sidewall 18, at a point two-thirds the height of the cup 10 and intermediate between the two recesses 20. The "mean container weight" reflects the average weight of both sets of containers. Similarly, the "mean container force" reflects the average force at which the container sidewall 18 deflected one quarter inch. These two quantities determine the "ratio" which is merely the mean container force divided by the mean container weight. Finally, the "ratio change" illustrates the improvement in force-to-weight ratio achieved by the present invention.

TABLE I

| | Point A on Sidewall | | | |
|---|---|---|---|---|
| Container Type | Mean Container Weight | Mean Container Force | Ratio | Ratio Change |
| Standard | 0.462 oz. | 16.2 oz. | 35.1 | N/A |
| Embodiments | 0.473 oz. | 17.4 oz. | 36.8 | 1.7 |

This data reflects a noticeable improvement in structural integrity on the main body of the sidewall 18 of the cup 10 of the present invention. The present invention creates a 4.8% increase in the force-to-weight ratio, as compared to a standard cup:

$$(1.7 \div 35.1) \times 100\% = 4.8\%$$

Therefore, containers utilizing the disclosed construction, including alternative embodiments, will offer a general increase in strength and structural integrity at any point on the sidewall 18. Depending on the specific features of the cup 10 (especially the number, size, location, and depth of the recesses 20) and the location of the test point, this increase in strength may vary from a slightly smaller increase (3-4%) to much larger increase.

The most marked increase in structural integrity occurs within the recesses 20 themselves. Table II includes the data obtained by testing the deflection at Point B, shown in FIG. 2. Point B is located within one of the longitudinal recesses 20 on the sidewall 18, at a point two-thirds the height of the cup 10 and on the centerline of the recess 20. The structural integrity of the sidewall 18 in the recesses 20 is more critical, as the cup 10 is designed so the user's hand exerts pressure on the recesses 20 when gripping the cup 10.

TABLE II

| | Point B in Recess | | | |
|---|---|---|---|---|
| Container Type | Mean Container Weight | Mean Container Force | Ratio | Ratio Change |
| Standard | 0.462 oz. | 16.3 oz. | 35.3 | N/A |
| Embodiments | 0.473 oz. | 24.0 oz. | 50.7 | 15.4 |

This data clearly reflects a significant improvement in structural integrity for the present invention. The present invention and its embodiments demonstrate a significant improvement in structural integrity as evidenced by a 43.6% increase in the force-to-weight ratio:

$$(15.4 \div 35.3) \times 100\% = 43.6\%$$

Therefore, containers utilizing the disclosed construction, including alternative embodiments, will offer a dramatic increase in strength and structural integrity in the recesses 20, as compared to a container without recesses 20. Again, depending on the features of the sidewall 18, especially the features of the recesses 20, this strength increase may be smaller or larger.

The recesses 20 have the further benefit of providing an ergonomic gripping surface for a user to grip the cup 10, an advantage over more rounded designs. The contoured surface created by the recesses 20 comfortably accommodates a variety of hand positions. Additionally, the recesses 20 promote gripping by the fingertips, creating a minimal area of contact between the fingertips and the cup 10. This may be beneficial in limiting heat transfer between the cup 10 and the user's hand when an uncomfortably cold beverage is held in the cup 10. Further, as described above, the recesses 20 are smooth and arcuately formed, creating a comfortable feel when gripped. However, the recesses 20 may also incorporate ridges or other friction-enhancing structures to reduce slippage when the cup 10 is gripped. Finally, it is beneficial that the recesses 20 provide the most comfortable points for gripping the container, because they are the strongest portions of the sidewall 18, as discussed above.

The arched portions 23 of the annular shoulder 22 and the beveled portions 27 of the lower portion 26 provide the additional benefit of stabilizing the cup 10 when it is in the hand of the user. Such a means for stabilizing the cup 10 when it is held by a user is desirable to increase the commercial appeal of the cup 10. The arched portion 23 can be used to increase stability by the user placing a fingertip underneath the arched portion 23 when holding the cup 10. When the fingertip (preferably the pinky or ring finger) is underneath the arched portion 23, the annular shoulder 22 sits on top of the fingertip, allowing the fingertip to exert both vertical force and rotational leverage on the annular shoulder 22. The beveled portion 27 provides a contact surface for the fingertip, further increasing the stability of the cup 10. These features allow the user to secure a better grip on the cup 10, as well as maintain greater control over the cup 10, especially when the user slips or is accidentally bumped, such as at a crowded party.

Figure 14:
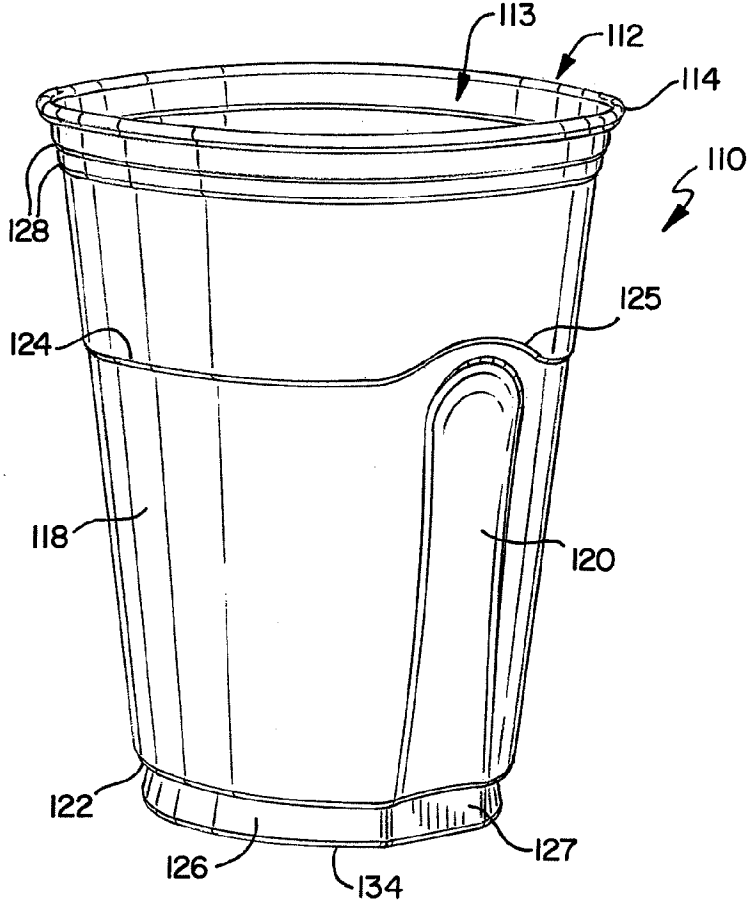
FIG. 14 is a perspective view of a cup representing an alternate embodiment of the present invention, having an elliptical base and no arched portions.
Figure 17:
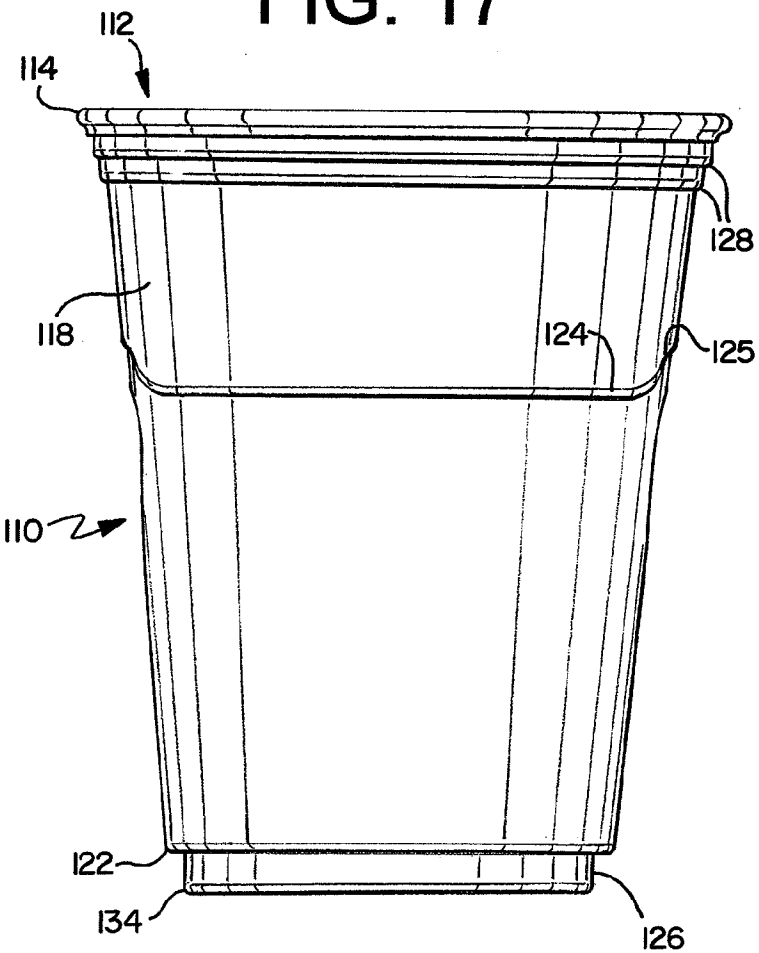
FIG. 17 is a side elevation view of the cup shown in FIG. 14, rotated 90 degrees from FIG. 16.
Figure 16:
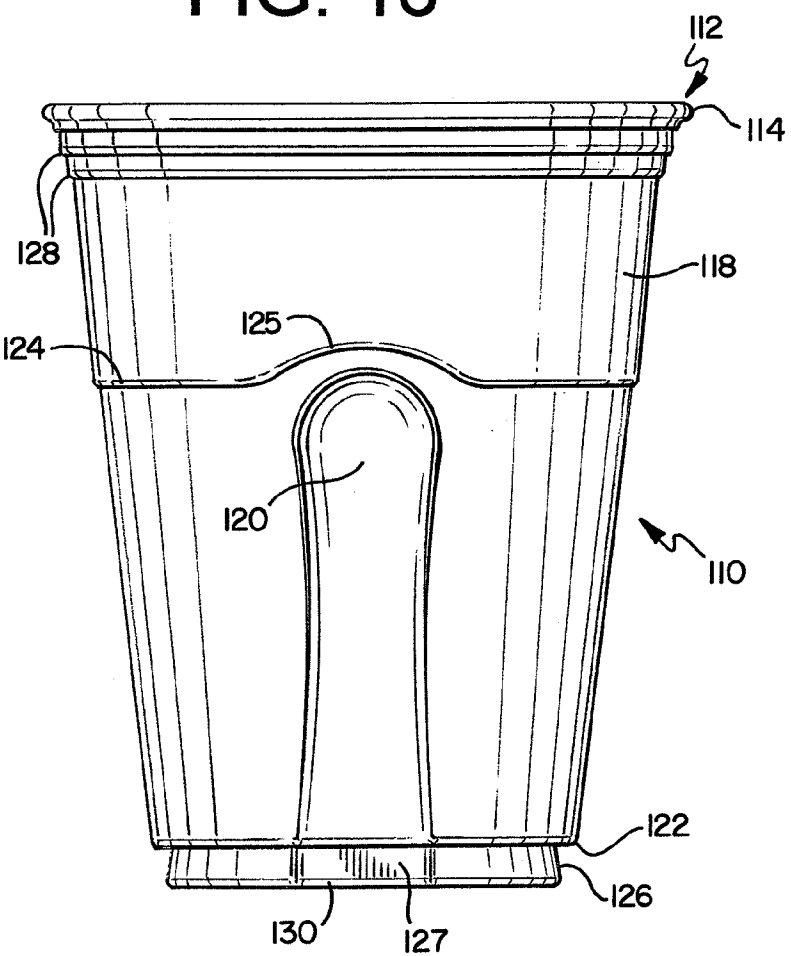
FIG. 16 is a side elevation view of the cup shown in FIG. 14.
Figure 19:
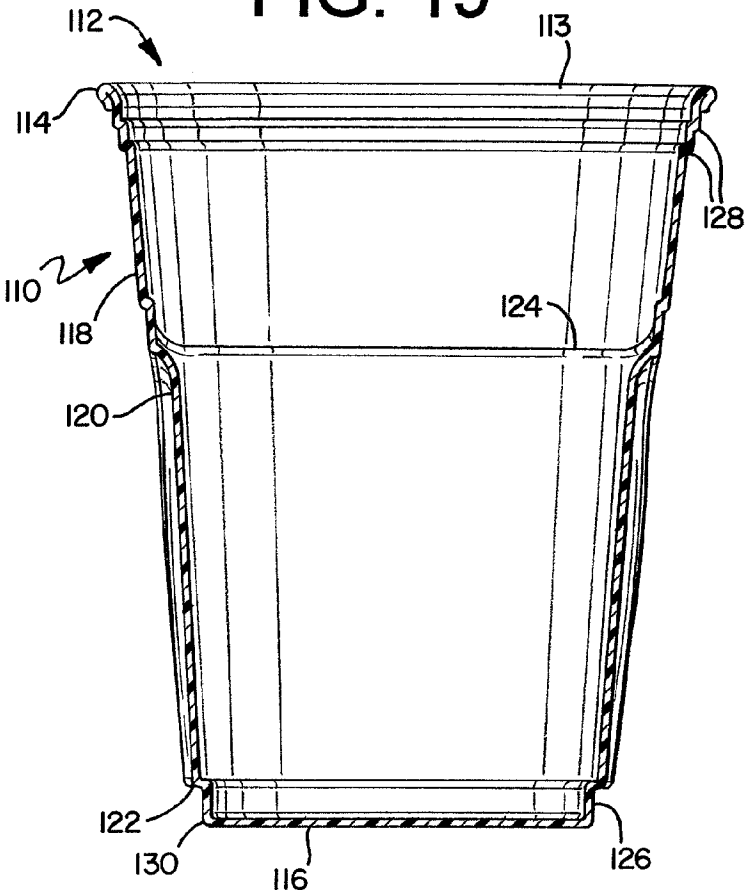
FIG. 19 is a cross-section view of cup shown in FIG. 14, taken along line 4-4 in FIG. 15.
Figure 18:
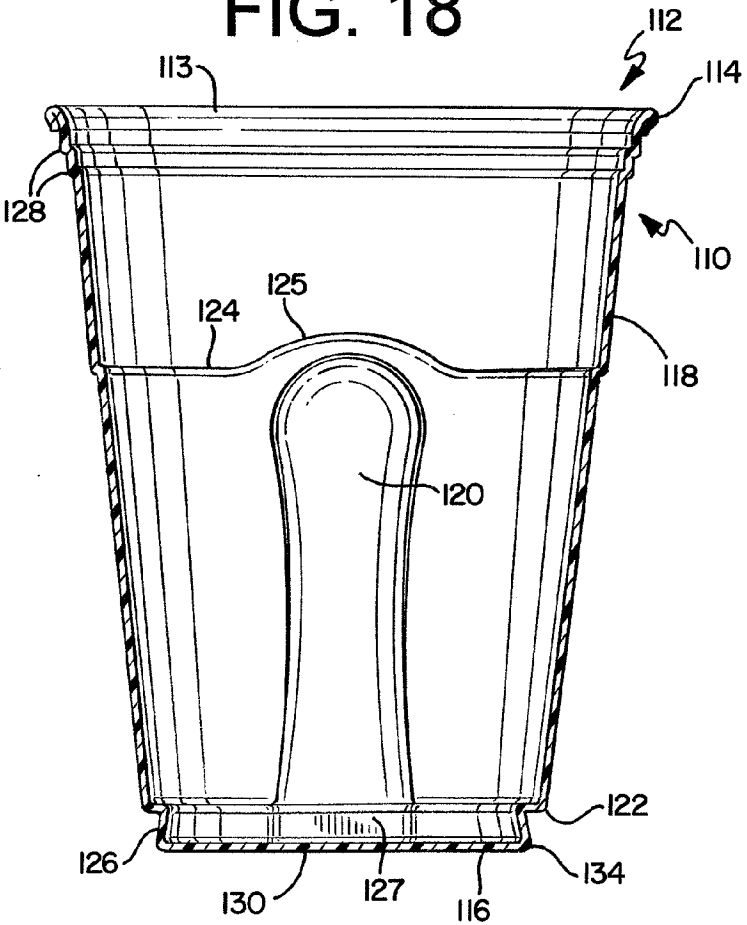
FIG. 18 is a cross-section view of the cup shown in FIG. 14, taken along line 3-3 in FIG. 15.
Figure 21:
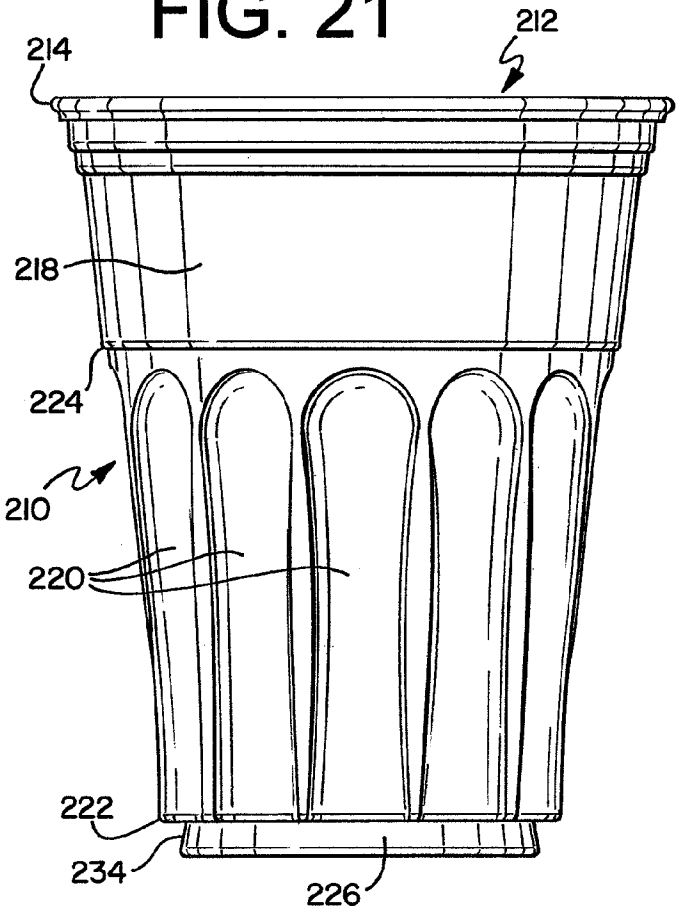
FIG. 21 is a side elevation view of the cup shown in FIG. 20.
Figure 20:
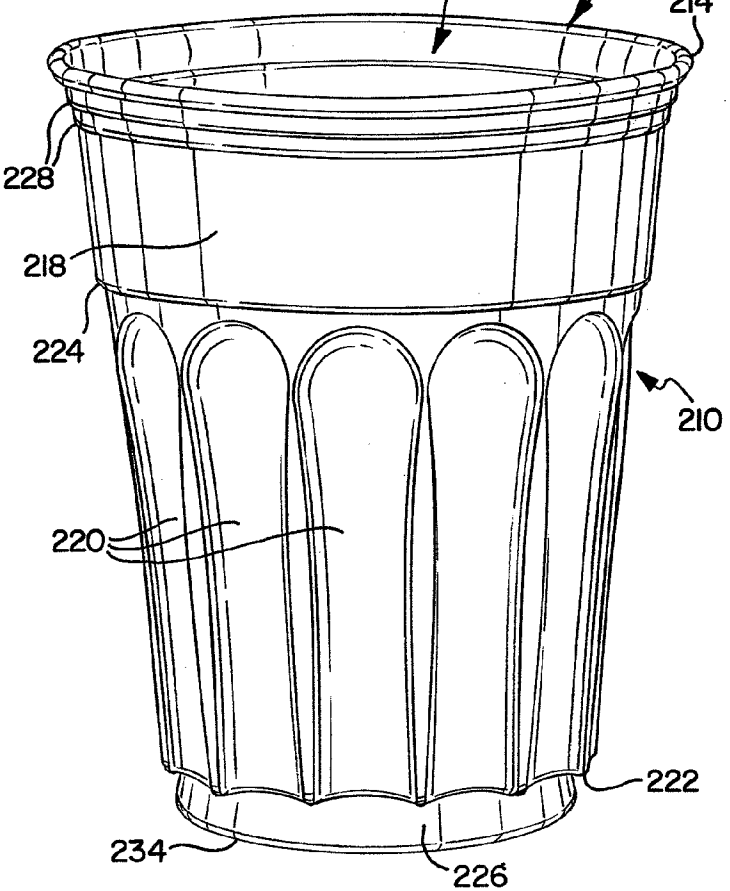
FIG. 20 is a perspective view of a cup representing an alternate embodiment of the present invention, having multiple recesses.
Figure 23:
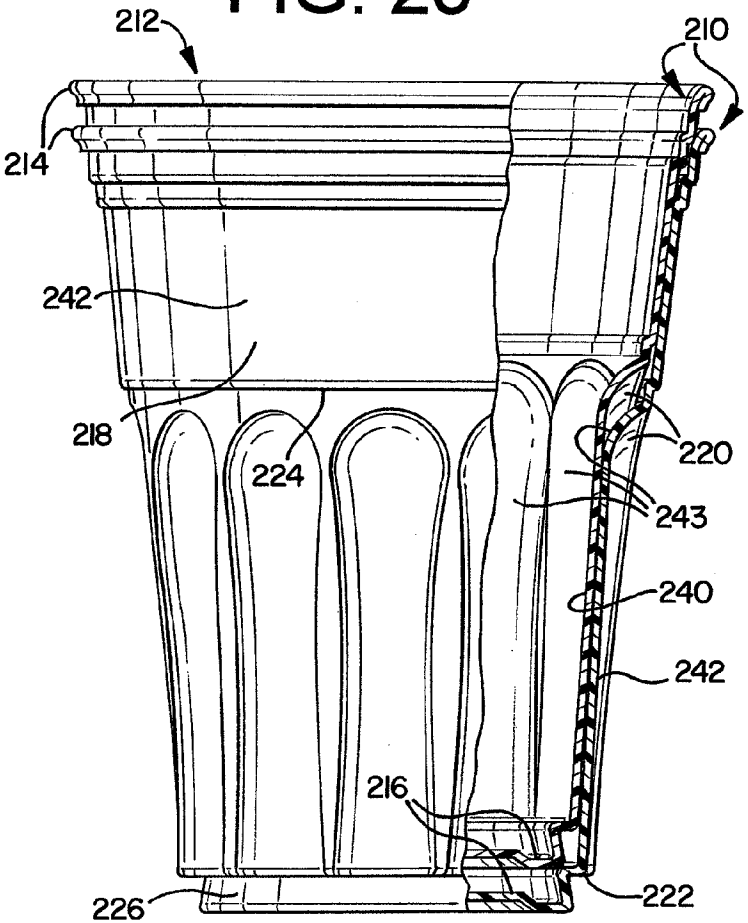
FIG. 23 is a broken cross-section view of the cup shown in FIG. 20 nested upon an identical cup.
Figure 22:
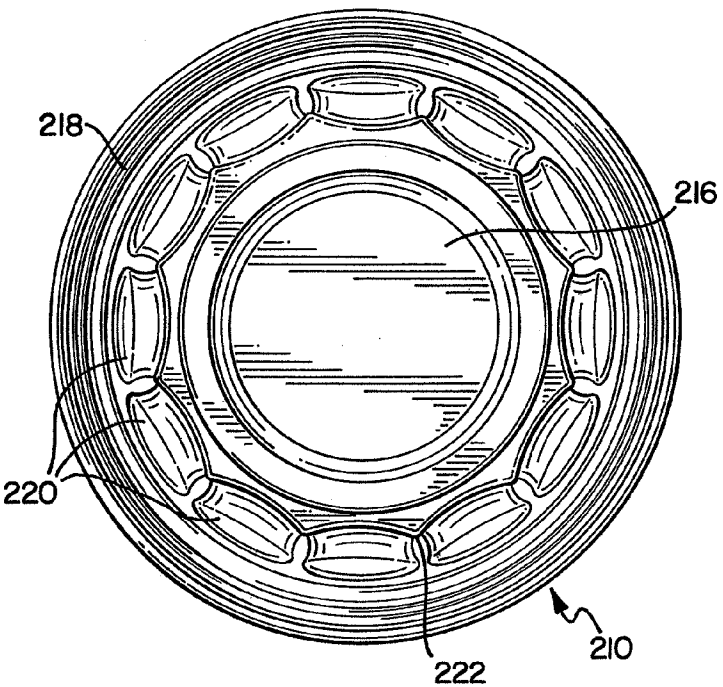
FIG. 22 is a bottom plan view of the cup shown in FIG. 20.

The present invention may be embodied in any one of a vast number of container configurations, limited only by the scope of the claims. An alternate embodiment of the present invention is contemplated and claimed, in which the annular shoulder 122,222 need not have any arched portions. Generally the container of the alternate embodiment is a thermoformed drinking cup 110,210 including an open top 112,212 defined by an annular rim 114,214, a base 116,216, and a sidewall 118,218 extending between the top 112,212 and the base 116,216. The sidewall 118,218 generally has a number of recesses 120,220, an annular shoulder 122,222 located between the recess 120,220 and the base 116,216, and a lower portion 126,226 extending between the annular shoulder 122,222 and the base 116,216, the recesses 120,220 terminating at the annular shoulder 122,222. As described and illustrated, the sidewall 118,218 of the alternate embodiment contains a number of recesses 120,220 in the range of from 1 to 20. The sidewall 118,218 preferably contains one or more annular ribs 124,128,224,228, and any of these annular ribs 124,128,224,228 may include a number of curved portions 125 equal to the number of recesses 120,220. Each of the number of curved portions 125 is aligned with one of the number of recesses 120, as illustrated in FIGS. 14-17, in which the cup 110 contains two recesses 120, and the rib 124 contains two curved portions 125. Additionally, the lower portion 126,226 of the sidewall 118,218 may contain a number of beveled portions 127 equal to the number of recesses 120,220. Each of the number of beveled portions 127 is aligned with one of the number of recesses 120, as illustrated in FIGS. 14 and 15, in which the cup contains two recesses 120 and the lower portion 126 contains two beveled portions 127.

Two specific forms of this alternate embodiment have been found to be advantageous. The first alternate embodiment is nearly identical to the preferred embodiment, except without arched portions, as illustrated in FIGS. 14-19. The second alternate embodiment likewise contains no arched portions, but contains a large number of recesses 220, as illustrated in FIGS. 20-23. These embodiments will each be discussed in turn.

The container of the first alternate embodiment, shown in FIGS. 14-19, is generally a thermoformed drinking cup including an open top 112 defined by a circular, annular rim 114, a base 116, and a sidewall 118 extending between the top 112 and the base 116. Like the preferred embodiment, the sidewall 118 has two longitudinal, arcuately formed recesses 120, an annular shoulder 122 located between the recesses 120 and the base 116, and three annular ribs 124,128. This embodiment includes a lower portion 126 extending between the annular shoulder 122 and the base 116 and having two beveled portions 127 aligned with the longitudinal recesses 120, with the recesses 120 terminating at the annular shoulder 122. One key difference in the first alternate embodiment, as noted above, is the absence of arched portions in the annular shoulder 122. A second key difference is the generally elliptical shape of the base 116, the base recess 132, the lower portion 126, and the annular shoulder 122, as opposed to the circular shape of the preferred embodiment. This elliptical shape has two benefits. The first is that it increases strength and rigidity in the recesses 120 by decreasing the radius of curvature near the recesses 120. The second benefit is that, as discussed above, the elliptical shape is another means of ensuring proper nesting. Although not preferred, the first alternate embodiment confers many of the same benefits as the preferred embodiment of the invention.

The container of the second alternate embodiment, shown in FIGS. 20-23, is also generally a thermoformed drinking cup 210 including an open top 212 defined by an annular rim 214, a circular base 216 having a circular base recess 232, and a sidewall 218 extending between the top 212 and the base 216. The sidewall 218 of this embodiment includes a lower portion 226 extending between the annular shoulder 222 and the base 216 and three annular ribs 224,228, and the recesses 220 terminate at the annular shoulder 222. The key difference found in the second alternate embodiment is that the sidewall 218 includes a larger number of arcuately formed longitudinal recesses 220. The number of longitudinal recesses 220 is generally in the range of from 2 to 12, but is preferably 12, as in FIG. 22. In another embodiment, the cup 10 has as many as twenty recesses 20. However, the potential number of recesses 220 is not limited by the scope of the present invention unless expressly limited, and is only limited by technology and practicality. Most importantly, the optimal number of recesses depends on the size of the container and the width of the recesses. Preferably, the annular shoulder 222 of this embodiment has no arched portions and the lower portion 226 has no beveled portions.

The large number of longitudinal recesses 220 in the second alternate embodiment is beneficial for three reasons. The first reason is the great degree of strength and integrity imparted on the sidewall 218 by the presence of the large number of recesses 220. The closely spaced recesses 220 disrupt any energy transferred to the sidewall 218 so quickly that the sidewall 218 "gives" very little to pressure at any location. The second reason is the ergonomic versatility created by the recesses 220, giving the user a large number of possible positions for holding the cup 210. The third reason, as explained above, is that using a large number of recesses 220 in a thin-walled container is an effective means for ensuring proper nesting of the containers upon each other. Although not preferred, the second alternate embodiment confers most of the benefits as the preferred embodiment of the invention, as well as some additional benefits.

The present invention was developed primarily for use in thermoformed drinking cups. However, the principles of the present invention are beneficial when applied to a multitude of other types of containers. Drinking cups made of any type of polymer, such as clear, opaque, or colored plastics or foam materials may be used in accordance with the present invention, as may cups made of non-polymeric materials. Many types of containers other than cups may also benefit from use of the disclosed features.

Although specific embodiments have been illustrated and described, numerous modifications are possible without departing from the essence of the invention. Accordingly, the scope of this patent is solely limited by the scope of the accompanying claims.

We claim:

1. A container comprising:

an open top defined by an annular rim;

a base defining a lowermost surface of the container; and a sidewall extending between the top and the base, the sidewall having an inner surface and an outer surface, the sidewall comprising a recess and an annular shoulder located between the recess and the base, the annular shoulder comprising an arched portion, the annular shoulder forming an inner stacking surface on the inner surface of the sidewall and the arched portion forming a raised ledge on the inner stacking surface, wherein a predominant portion of the inner stacking surface lies in a single horizontal plane, the sidewall being configured such that a base of a second identical container is configured to rest upon the inner stacking surface and the raised ledge is configured to sit within an arched portion of the second identical container when the second identical container is nested upon the container.

2. The container of claim 1 wherein the annular shoulder further comprises a means for stabilizing the container when the container is held by a user.

3. The container of claim 1 wherein the recess terminates at the annular shoulder.

4. The container of claim 1 wherein the sidewall further comprises an annular rib.

5. The container of claim 1 wherein the sidewall further comprises multiple annular ribs, at least one of the annular ribs comprising a curved portion aligned with the recess.

6. The container of claim 1 wherein the recess is longitudinal and arcuately formed.

7. The container of claim 1 further comprising a measurably improved strength to weight ratio over a substantially similar sidewall having no recesses.

8. The container of claim 1 further comprising an improved strength to weight ratio of at least 3% over a substantially similar sidewall having no recesses.

9. The container of claim 1 further comprising an improved strength to weight ratio of at least 20% over a substantially similar sidewall having no recesses.

10. The container of claim 1 comprising an improved strength to weight ratio of at least 40% over a substantially similar sidewall having no recesses.

11. The container of claim 1 wherein the sidewall further comprises a lower portion extending between the annular shoulder and the base, the lower portion comprising an exterior indented surface aligned with the recess.

12. The container of claim 1 wherein the sidewall further comprises a lower portion extending between the annular shoulder and the base, the lower portion comprising an exterior indented surface aligned with the arched portion.

13. The container of claim 1 wherein the sidewall further comprises an exterior indented surface filling the area between the arched portion and the base.

14. The container of claim 13 wherein the exterior indented surface is concave.

* * * * *